US011299947B2

(12) United States Patent
Wardley

(10) Patent No.: US 11,299,947 B2
(45) Date of Patent: Apr. 12, 2022

(54) RELATING TO WELL ABANDONMENT

(71) Applicant: Ardyne Holdings Limited, Aberdeen (GB)

(72) Inventor: Michael Wardley, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 71 days.

(21) Appl. No.: 16/650,475

(22) PCT Filed: Sep. 28, 2018

(86) PCT No.: PCT/GB2018/052768
§ 371 (c)(1),
(2) Date: Mar. 25, 2020

(87) PCT Pub. No.: WO2019/069055
PCT Pub. Date: Apr. 11, 2019

(65) Prior Publication Data

US 2021/0198955 A1 Jul. 1, 2021

(30) Foreign Application Priority Data

Oct. 3, 2017 (GB) ..... 1716096
Jul. 10, 2018 (GB) ..... 1811289

(51) Int. Cl.
*E21B 29/02* (2006.01)
*E21B 29/00* (2006.01)
(Continued)

(52) U.S. Cl.
CPC ..... *E21B 29/005* (2013.01); *E21B 10/322* (2013.01); *E21B 17/07* (2013.01); *E21B 29/002* (2013.01); *E21B 33/13* (2013.01)

(58) Field of Classification Search
CPC ..... E21B 29/002; E21B 29/005
See application file for complete search history.

(56) References Cited

U.S. PATENT DOCUMENTS 3,224,507 A 12/1965 Cordary et al.
5,074,355 A 12/1991 Lennon
(Continued)

FOREIGN PATENT DOCUMENTS

EP 1076758 B1 6/2004
EP 3085882 A1 10/2016
WO WO 99/57409 11/1999

OTHER PUBLICATIONS

European Patent Office as Int'l Search Authority, International Search Report and Written Opinion for PCT/GB2018/052767; dated Jan. 17, 2019; all pages; European Patent Office, Rijswijk, The Netherlands.

(Continued)

*Primary Examiner* — Giovanna Wright
(74) *Attorney, Agent, or Firm* — Law Office of Jesse D. Lambert, LLC

(57) ABSTRACT

Apparatus (10) and method for removing a section of well tubing. A work string including a hydraulic tensioning device (14) and a section mill (12) a run in a rigless arrangement to provide continuous upward milling of the tubing (24) by raising the work string at a desired rate of progress. The hydraulic tensioning device (14) has a lower end (34) moveable longitudinally relative to the work string by application of fluid pressure in the work string to apply a weight on the section mill. The hydraulic tensioning device includes a self-correcting mechanism (30) to maintain the lower end at a position between a fully extended position and a fully retracted position to provide continuous milling of the tubing by the section mill at a milling rate matching the rate at which the work string is lifted. Embodiments are described for use in a rigless well abandonment procedure.

20 Claims, 4 Drawing Sheets

(51) Int. Cl.

| | |
|---|---|
| ***E21B 10/32*** | (2006.01) |
| ***E21B 17/07*** | (2006.01) |
| *E21B 33/13* | (2006.01) |

(56) References Cited

U.S. PATENT DOCUMENTS

| | | | | |
|---|---|---|---|---|
| 6,679,328 | B2 | 1/2004 | Davis et al. | |
| 2002/0162659 | A1 | 11/2002 | Davis et al. | |
| 2011/0297379 | A1 | 12/2011 | Laird et al. | |
| 2012/0292028 | A1 | 11/2012 | Crow et al. | |
| 2013/0284458 | A1 | 10/2013 | Dancer et al. | |
| 2014/0034317 | A1 | 2/2014 | Smith | |
| 2017/0321495 | A1 * | 11/2017 | Hered | E21B 29/12 |

OTHER PUBLICATIONS

Intellectual Property Office of the UK Patent Office, Combined Search and Examination Report for GB1716096.1; dated Nov. 17, 2017; all pages; Intellectual Property Office, Newport, South Wales.

Uropean Patent Office as Int'l Search Authority, International Search Report and Written Opinion for PCT/GB2018/052768; dated Jan. 28, 2019; all pages; European Patent Office, Rijswijk, The Netherlands.

Ntellectual Property Office of the UK Patent Office, Combined Search and Examination Report for GB1815831.1; dated Mar. 13, 2019; all pages; Intellectual Property Office, Newport, South Wales.

* cited by examiner

RELATING TO WELL ABANDONMENT

FIELD OF THE INVENTION

Background of the Invention

The present invention relates to methods and apparatus for well abandonment and in particular, though not exclusively, to an apparatus and method for removing a portion of a tubular across a longitudinal section of the well to enable the placement of a cement plug.

When a well has reached the end of its commercial life, the well is abandoned according to strict regulations in order to prevent fluids escaping from the well on a permanent basis. In meeting the regulations it has become good practise to create the cement plug over a predetermined length of the well. As a well is constructed by locating conduits such as casing, lining, pipe and tubing (herein collectively referred to as tubulars) into the well, the cement plug must extend over all annuli present in the well. In many cases all conduits are removed leaving the outer casing, including the annulus bounded by the formation.

One method of creating or repairing the cement plug is to mill away the inner tubular to expose the annulus behind the tubular and then pump cement into the enlarged area to create the cement plug. This is achieved using a rotatable section mill run on a work string and typically operated downwardly to remove the tubular section. In milling downwardly, the weight of the work string is used to apply downward force to the section mill (weight on mill) to cause it to progress through the tubular being milled providing a rate of progress or rate of milling, typically in feet of tubular milled per hour.

Rigless methods of well abandonment are now being proposed in which the operation is carried out from a floating vessel. By removing the requirement for a drilling rig, significant time and therefore costs can be made in the well abandonment procedure. In a rigless method the work string is anchored to the tubular and as such sea swell will place tension and/or weight on the work string. Even with the use of heave compensators, this variable load means that a section mill, reliant on using the weight of the work string to operate, cannot be used.

To allow section milling in a rigless arrangement, U.S. Pat. No. 6,679,328 discloses a method and apparatus for milling a section of casing in an upward direction, utilizing a downhole hydraulic thrusting mechanism for pulling a section mill upwardly. The hydraulic thrusting mechanism has a stroke length, such that when the mechanism 'bottoms-out' at the end of the stroke, milling is stopped. The mill blades are retracted, pressure reduced and the mechanism allowed to extend to its full stroke length again. The mill blades are repositioned at the end of the milled casing and milling begins again. Casing sections equivalent to the stroke length of the mechanism can be milled at a time but the stopping to extend the mechanism and reposition the section mill limits the overall rate of progress.

It is therefore an object of the present invention to provide apparatus for removing a section of well tubing which obviates or mitigates at least some of the disadvantages of the prior art.

It is a further object of the present invention to provide a method of removing a section of well tubing which obviates or mitigates at least some of the disadvantages of the prior art.

SUMMARY OF THE INVENTION

According to a first aspect of the present invention there is provided apparatus for removing a section of well tubing comprising: a work string;

a hydraulic tensioning device having an upper end and a lower end, the upper end being attachable to the work string, the lower end being moveable longitudinally relative to the upper end by a stroke length between a fully extended position and a fully retracted position in response to fluid pressure within the mechanism and a load applied on either end;

a section mill attachable to the lower end of the hydraulic tensioning device, the section mill including a plurality of blades, the blades being arranged to move from a first position within the section mill to a second position being extended to contact the well tubing and thereby mill the tubing in an upward direction;

characterised in that: the hydraulic tensioning device includes a self-correcting mechanism to maintain the lower end between the fully extended position and the fully retracted position to provide continuous milling of the well tubing by the section mill at a rate of progress matching a rate at which the work string is lifted.

In this way, the hydraulic tensioning device maintains the lower end at a mid-stroke position preventing it from bottoming out. A mid-stroke position can be considered as the device operating between the fully extended position and the fully retracted position. As the load applied at the fully extended position and the fully retracted position is unpredictable, maintaining the device in a mid-stroke position allows a controlled load to be applied to the section mill.

Advantageously, the user can select the rate of progress (or rate of milling) by the rate they lift the work string at surface and the hydraulic tensioning device will automatically correct itself to maintain the correct load on the cutter blades as the work string is continuously raised. This is in contrast to the prior art in which the work string is not moved while the hydraulic tensioning device pulls the cutter blades up towards the stationary work string. This means that longer sections of casing i.e. multiple times the stroke length, can be milled without requiring the section mill to be stopped and repositioned at intervals.

Preferably the work string has a through bore for the passage of fluid from surface to extend the cutter blades and move the lower end of the hydraulic tensioning device relative to the upper end. In this way, the apparatus can be operated from surface.

Preferably the hydraulic tensioning device comprises a cylindrical body providing an outer mandrel and an inner mandrel telescopically arranged in respect to the outer mandrel, with a cylindrical bore therethrough. In this way the mandrels can move longitudinally over the stroke length.

Preferably the outer mandrel includes a prong having an elongate body arranged on a central axis of the cylindrical body and the inner mandrel includes a restriction therein, which limits the passage of fluid through the cylindrical bore when the prong is arranged in the restriction. In this way a back pressure can be created between the inner and outer mandrels which creates a load or tension upon the section mill.

Alternatively the inner mandrel includes a prong having an elongate body arranged on a central axis of the cylindrical body and the outer mandrel includes a restriction therein, which limits the passage of fluid through the cylindrical bore when the prong is arranged in the restriction. The restriction may be a nozzle or choke.

Preferably the self-correcting mechanism comprises a profile on an outer surface of the elongate body of the prong. The profile will determine the flow area between the prong and the restriction. More preferably the profile comprises one or more longitudinally arranged grooves on the outer surface and wherein a depth of each groove varies along its length.

More preferably the depth of the grooves are tapered. In this way, the flow area through the restriction can be varied depending on the position of the prong within the restriction and consequently this will vary the back pressure and the load on the section mill.

In an alternative embodiment the self-correcting mechanism comprises a profile along an inner surface of the restriction.

The apparatus may include a downhole motor. In this way, the section mill can be rotated downhole instead of via rotation of the work string. The work string may be threaded pipe, being right or left-handed. Alternatively the work string may be coiled tubing. In this way, the section mill can be arranged to be left-hand turned so as to prevent the unthreading of sections of the tubular being milled. The apparatus may include an anchor to prevent rotation of the work string. In this way, the work string above the motor is prevented from winding. The anchor may be an anti-torque anchor which includes friction elements to prevent undesired rotation of the work string.

A spiral auger may be located below the section mill to assist in moving cuttings downhole. In this way, cuttings do not have to be circulated to surface and disposed of.

According to a second aspect of the present invention there is provided a method for removing a section of well tubing comprising the steps:

a) providing a work string with a hydraulic tensioning device and a section mill mounted below the hydraulic tensioning device, the hydraulic tensioning device operating over a stroke length between a fully extended position and a fully retracted position;
b) selecting a desired rate of progress and calculating a pump flow rate to create a back pressure in the hydraulic tensioning device to maintain the hydraulic tensioning device between the fully extended position and the fully retracted position;
c) lowering the work string into tubing to be milled;
d) pumping fluid through the work string to actuate the section mill and extend cutter blades;
e) rotating the section mill to mill the tubing with the cutter blades;
f) pumping fluid at the calculated pump flow rate through the work string and actuating the hydraulic tensioning device to position the lower end of the hydraulic tensioning device between the fully extended position and the fully retracted position while milling the tubing;
g) maintaining the calculated pump flow rate while raising the work string at the desired rate of progress to continuously mill the tubing;
h) in the event that the rate of milling is lower than the desired rate of progress and the lower end of the hydraulic tensioning device moves downwards away from the work string towards the fully extended position, auto-correcting the hydraulic tensioning device to return the lower end to a position between the fully extended position and the fully retracted position by increasing a load on the section mill to thereby speed up the rate of milling;
i) in the event that the rate of milling is higher than the desired rate of progress and the lower end of the hydraulic tensioning device moves upwards towards the work string towards the fully retracted position, auto-correcting the hydraulic tensioning device to return the lower end to a position between the fully extended position and the fully retracted position by decreasing a load on the section mill to thereby slow down the rate of milling;
j) repeating steps (h) and (i) as required while performing step (g) to remove a longitudinal section of the tubing.

In this way, the load on the mill is automatically adjusted to keep the rate of milling at a desired value matching the rate of progress or lifting rate of the work string, so that continuous milling of tubing is achieved while ensuring the device is never fully extended or fully retracted. This makes the invention available for use in a rigless method. There is also no requirement to stop milling and reposition the section mill as required in the prior art as the method does not rely on the hydraulic tensioning device being stroked. Consequently continuous milling of long sections of tubing, typical multiple time the stroke length of the hydraulic tensioning device are achievable in a continuous operation without stopping the rotation of the blades.

By continuously milling, the wear on the cutter blades is reduced desired as compared to the prior art and lengths of tubing such as 100-200 feet can be removed in a single trip.

Preferably, the auto-correction occurs by changing a flow area through the hydraulic tensioning device in response to movement of the lower end of the hydraulic tensioning device.

Preferably, step (f) includes using the fluid flow through the hydraulic tensioning device to actuate the hydraulic tensioning device to hydraulically pull a lower end of the hydraulic tensioning device upwards towards the work string to a mid-stroke position while milling the tubing. In this way, the hydraulic tensioning device is in the fully extended position when the apparatus is run into the well.

Alternatively, step (f) includes raising the work string at a rate faster than the desired rate of progress so as to actuate the hydraulic tensioning device to extend such that the lower end of the hydraulic tensioning device moves downwards relative to the work string to a mid-stroke position while milling the tubing. In this way, the hydraulic tensioning device is in the fully retracted position when the apparatus is run into the well.

Preferably step (f) includes shearing one or more pins to allow the lower end of the hydraulic tensioning device to move relative to the work string.

The method may include the step of changing the desired rate of progress by varying the pump flow rate through the work string in combination with raising the work string at the changed desired rate of progress.

Preferably the method includes monitoring a fluid pressure signal at surface. In this way, it can be determined that the hydraulic tensioning device is at mid-stroke between the fully extended and fully retracted positions.

The method may include the steps of stopping raising the work string so as to allow the lower end of the hydraulic tensioning device to move upwards towards the work string while milling the tubing. In this way, the apparatus can be used to mill through a coupling on the tubing. Preferably, the pressure signal is monitored during this process to prevent the hydraulic tensioning device bottoming out at the fully extended or fully retracted positions.

Advantageously, the work string is lowered from a floating vessel. In this way, a section of tubing can be removed in a rigless arrangement.

Preferably the method includes the step of rotating the work string to rotate the section mill. Alternatively the method may include the step of actuating a downhole motor to rotate the section mill.

The method may include the step of cutting through the tubing prior to milling the tubing. In this way the tubing can be cut and milled on a single trip. Advantageously, the cut can be made by the cutter blades which are also used to mill the tubing.

The method may include the step of disposing of cuttings downhole. In this way, cuttings do not have to be circulated to surface and disposed of.

The method may include the step of inserting a seal in the well tubing at a location below the section of well tubing to be removed. The seal may be a bridge plug, a cement plug or a packer. The method may include the further step of conducting a cement bond log (CBL) over the length of well in which the section of well tubing has been removed. This would allow a test on cement bond integrity behind an outer tubular in the well. The method may further include cementing over the length of well in which the section of well tubing has been removed.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Additionally the terms "above", "below", "upper" and "lower" are relative and take their standard meaning when considering a standard vertical will with "lower" being upstream and "upper" being downstream in the well.

BRIEF DESCRIPTION OF THE DRAWINGS

There will now be described, by way of example only, various embodiments of the invention with reference to the drawings, of which.

DETAILED DESCRIPTION OF THE INVENTION

Figure 1:
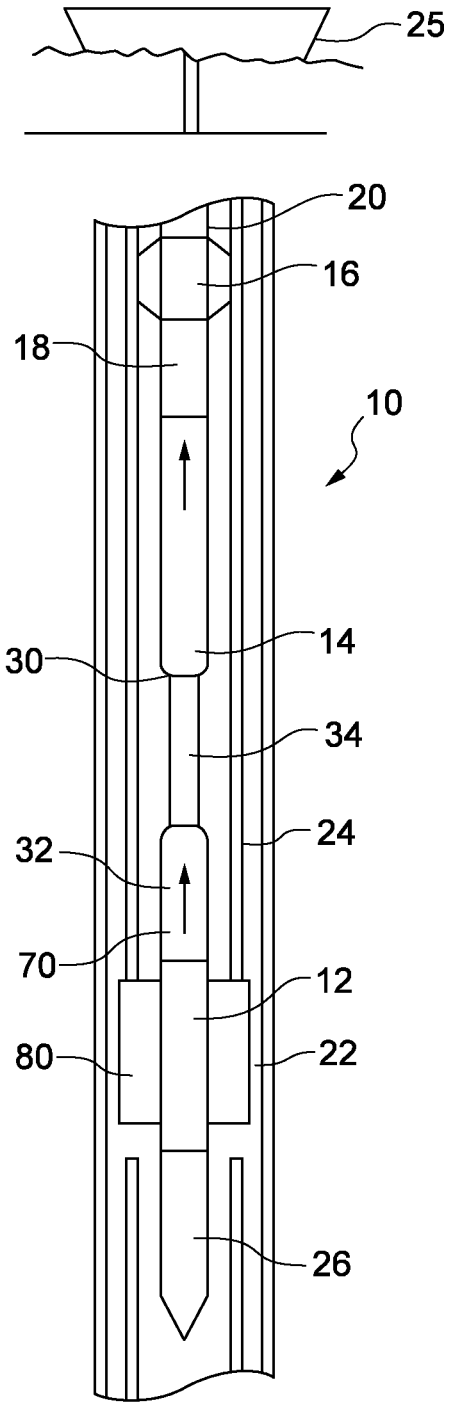
FIG. 1 is a schematic illustration of apparatus for removing a section of well tubing carrying out a method for removing a section of well tubing according to an embodiment of the present invention.

Referring initially to FIG. 1 of the drawings there is illustrated apparatus, generally indicated by reference numeral 10, having a section mill 12 and a hydraulic tensioning device 14 for removing a section of well tubing. The hydraulic tensioning device 14 includes a self-correcting mechanism 30 to maintain the hydraulic tensioning device between a fully extended position and a fully retracted position, and provide continuous milling over a length of tubing 24 greater than a stroke length of the hydraulic tensioning device, according to an embodiment of the present invention.

Like the arrangement of U.S. Pat. No. 6,679,328, incorporated herein by reference, the section mill 12 is designed for upward milling, in combination with an up-thruster tool, the hydraulic tensioning device 14, an anti-torque anchoring tool 16, and a downhole motor 18, which are mounted to a work string 20. In the present invention, the work string 20 is coiled tubing. The apparatus 10 is tripped into the hole to position the section mill 12 at the lower end of the interval where a section 22 or window is to be cut. For clarity, FIG. 1 actually shows the apparatus 10 after the inner tubular 24 has been cut through, and after the milling of the section 22 has begun. The section mill 12 is at the bottom of the apparatus 10, with the hydraulic tensioning device 14, a mud motor 18, and anti-torque anchoring tool 16 positioned above that, in order. A spiral auger 26 can be positioned below the section mill 12, to assist in moving the cuttings downhole.

The hydraulic tensioning device 14 may be considered as a load control sub or a pressure balanced weight transfer sub. The purpose of the hydraulic tensioning device 14 is to automatically adjust the load or weight on the section mill so that a desired rate of progress of milling is achieved. When operated from a floating vessel 25 in a rigless arrangement, upward milling would be impossible unless an appropriate load can be maintained on the mill as an operator would be unable to raise the work string to provide a constant load in the presence of heave from the floating vessel 25.

Figure 2A:
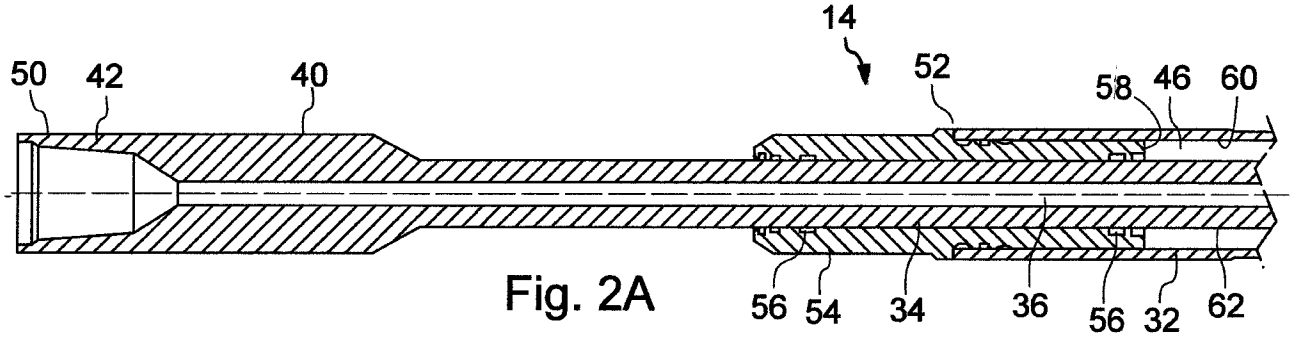
FIGS. 2A to 2C are cross-sectional views of a hydraulic tensioning device in a mid-stroke position according to an embodiment of the present invention.
Figure 2B:
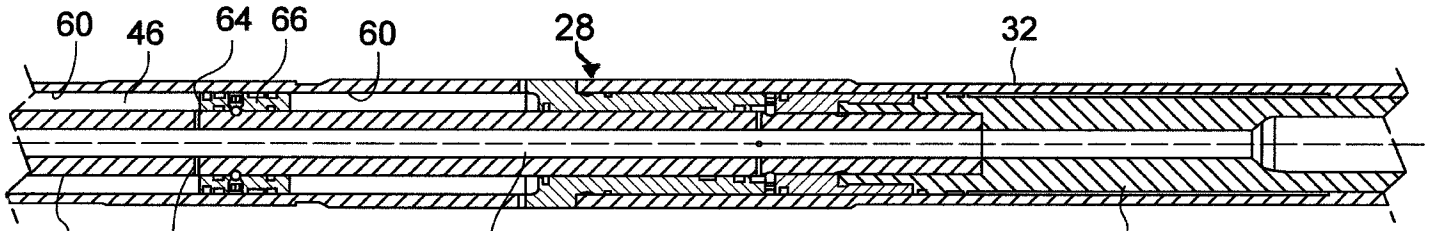
Figure 2C:
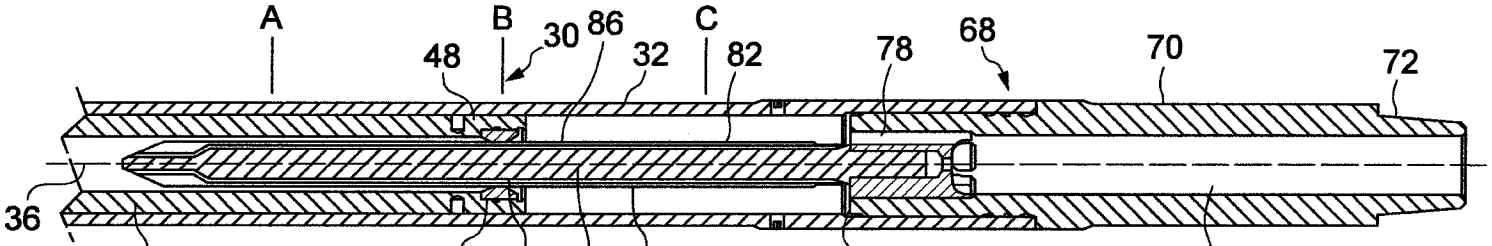

Referring now to FIGS. 2A-C there is illustrated a hydraulic tensioning device 14. In principle the hydraulic tensioning device 14 comprises a substantially cylindrical body 28 having an outer mandrel 32 which slides over an inner mandrel 34. Fluid pumped through a central bore 36 meets a restriction, choke or nozzle 38 which causes a back pressure in the bore 36. The fluid is then forced between the mandrels 32,34 and with one mandrel 34 held in position relative to the work string 20, the other mandrel 32 will move relative to the fixed mandrel 34. As long as fluid is pumped at a constant rate the back pressure will be constant and the movement of the mandrel 32 will be constant thereby imparting a constant load or tension upon anything connected to it.

Inner mandrel 34 is part of a top sub 40 which includes a standard box section 42 for attachment of the hydraulic tensioning device 14 to the work string 20. The inner mandrel 34 contains ports 44 through the body of the mandrel 34 to access a chamber 46 between the mandrels 32,34. The inner mandrel 34 has the nozzle 38 located within the central bore 36 attached at a lower end 48. The box section 42 at the upper end 50 of the top sub 40 has a first diameter with the inner mandrel 34 having a smaller diameter than the first diameter.

Arranged over the inner mandrel 34 is the outer mandrel 32. At an upper end 52 of the outer mandrel 32 there is a locking sub 54. This provides sliding seals 56 between the mandrels 32,34 and a wall 58 of the chamber 46. The chamber 46 is otherwise formed by inner wall 60 of the outer mandrel 32, the outer wall 62 of the inner mandrel 34 and a wall 64 of a piston 66 fixed to the wall 62 of the inner mandrel 34. The ports 44 are arranged to access the chamber 46 beside the wall 64 of the piston 66. It is the travel of the piston 66 with the inner mandrel 34 which gives the stroke length for the hydraulic tensioning device. This distance may be set to one to two metres. However it may be set to shorter lengths if desired. The stroke length is the relative distance travelled by the mandrels 32,34 between a fully extended configuration and a fully retracted configuration.

At a lower end 68 of the outer mandrel 32 there is a bottom sub 70 including a standard pin connection 72 for attachment to another tool such as the section mill 12. The outer diameter of the outer mandrel 32 and pin section 72 matches the outer diameter of the box section 42 of the top sub 40 to ensure there are no parts to catch in the well bore.

Figure 3A:
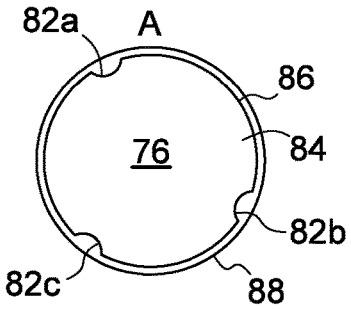
FIGS. 3A to 3C are a cross-sectional views of the prong of the hydraulic tensioning device of FIGS. 2A-C at locations A, B and C respectively.
Figure 3B:
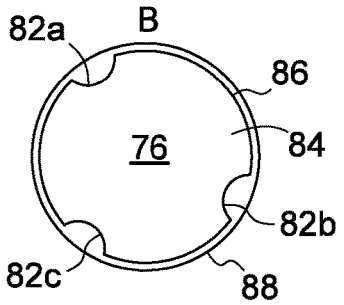
Figure 3C:
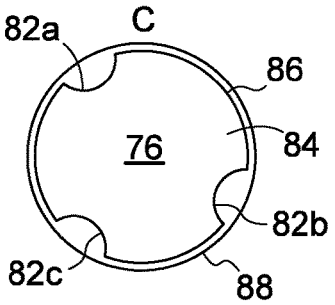

Mounted on the upper end 74 of the bottom sub 70 is a prong 76. Prong 76 forms the self-correcting mechanism, generally indicated by reference numeral 30, used to vary the flow area through the nozzle 38. The prong 76 lies on the central axis of the bore 36 within the outer mandrel 32 and is sized to locate within and slide through the nozzle 38. Through ports 78 are arranged in the bottom sub 70 to provide a fluid pathway along the central bore 36 around the prong 76. The prong 76 is an elongate substantially cylindrical body 84 in which grooves 82 have been machined along the length of its outer surface 86. In the embodiment shown there are three channels or grooves 82*a-c* as illustrated in FIGS. 3A-C which show a transverse cross-section through the prong 76 at three locations along the length of the prong indicated as A, B and C in FIG. 2C. The inner surface 88 of the nozzle 38 is also illustrated to show the restriction in the cross-section flow area through the apparatus 10 at the nozzle 38. While three grooves 82*a-c* are shown, each having a curved profile, there may be any number of grooves and they may be of any profile, the only critical factor being that the cross-sectional flow area must increase, or decrease, along the length of the prong 76. This is achieved in the embodiment shown by tapering the grooves 82*a-c*. Thus the grooves 82*a-c* have a depth which becomes shallower from the lower end 48 of the inner mandrel 34 to the upper end 52 of the inner mandrel 34. By changing the cross-sectional flow area through the nozzle 38 by changing the longitudinal position of the prong 76 in the nozzle 38, the back pressure can be altered and consequently the pressure in the chamber 46 is varied to move the piston 66 and inner mandrel 34 relative to the outer mandrel 32. This movement consequently varies the effective load or weight applied to the section mill 12 connected to the inner mandrel 32.

The inner wall 60 of the outer mandrel 32 and the outer wall 62 of the inner mandrel 34 will have splined sections, typically around the nozzle 38, so that rotation of the top sub 40 via the work string 20 and, if present a downhole motor 18, is transmitted through the entire hydraulic tensioning device 14 to the section mill 12 located on the bottom sub 70.

Returning now to FIG. 1, the hydraulic tensioning device 14 is shown in its mid-stroke position between a fully extended position and a fully retracted position matching the arrangement illustrated in FIGS. 2A-C. The section mill 12 is attached to the bottom sub 70.

The section mill 12 may be as shown in U.S. Pat. No. 6,679,328 having a plurality of arms each pivoted around a point, mounted in longitudinal slots, which are held in the open position by an upward moving wedge block moved by a piston to support the arms and prevent them from collapsing under heavy loading. Actuation of the section mill 12 is achieved by pumping fluid through the work string 20 which acts on the piston. Release of hydraulic pressure will allow the arms to retract back into the body of the mill 12. The section mill arm can be fitted with a casing cutter type blade for penetration of the tubing, or the arm can be fitted with the square type blades typically found on a pilot mill, to provide for milling an extended length of tubing. In this embodiment, the section mill 12 can first be operated to penetrate the tubing with the casing cutter type blade, then the arms can be exchanged for arms having the pilot mill type blades, for the remainder of the procedure.

An alternative section mill 12 is described in Applicants co-pending patent application GB1713525.2, incorporated herein by reference. This section mill 12 includes elongate blades 80 which have a cutting structure extending along at least a portion of a length from a first edge and at least a portion of a width from a second edge of the elongate cutter blade, the second edge being longer than the first edge, the first and 20 second edges being perpendicular to each other. The blades are moved axially and radially relative to the tubular body to arrange the second edge parallel to the central longitudinal axis for milling. As the blades are moved out the apex, where the first edge meets the second edge, acts as a cutter and will cut the tubing thereby opening up a window in the tubing as the blades are extended. Consequently this means that the initial cutting and subsequent milling of the tubing does not require a change of blades and the elongate blades allow an entire section of tubing in excess of 200 feet to be removed on a single trip in the well. This section mill can also be operated by fluid pressure acting on a piston and is thus operable from surface.

Also shown in FIG. 1 is an anti-torque anchor 16 and a downhole motor 18. The motor must be present when the work string 20 is coiled tubing or threaded pipe, typically drill pipe, having the standard right-hand thread. A motor may be optionally used with a left-hand threaded pipe work string. In this embodiment the downhole motor 18 is typically a mud motor as is known in the art. It will drive the string below in a left-hand turn. This is needed as the section mill 12 should preferably be left-hand turned so as to prevent the unthreading of sections of the inner tubular 24 when being milled. Consequently an anti-torque anchor 16 is required above the motor 18 to prevent the coiled tubing from winding as the section mill 14 presents a fixed point against the tubular 24. The anti-torque anchor 16 typically comprises rollers and friction blocks to allow the work string to turn in a right-hand direction when the string 20 is run in but discourage left-hand turning when the motor 18 is operated. The anchor 16 will allow the work string 20 to be raised relative to the tubular 24.

In use, the apparatus 10 is run into the inner tubular 24, in the arrangement shown in FIG. 1. The hydraulic tensioning device 14 may be in a fully extended configuration wherein the wall 64 of piston 66 abuts the wall 58 of the locking sub 54 so that the chamber 46 is empty. The prong 76 will sit below and clear of the nozzle 38. With the section mill 12 positioned at a lower end of the section 22 to be cut, fluid is pumped down the central bore 36 of the work string 20, to actuate the section mill 12. The section mill 12 will rotate either through the work string alone or via the motor 18, if present. Blades 80 will initially radially extend to cut through the tubular 24 and then the blades 80 will move to the longitudinal position shown. The long side of the blade will mill the tubular 24 as the blades are extended. In the preferred embodiment of section mill 12, the blades 80 will lock in the extended position so that variations in fluid pressure through the mill 14 will not affect the milling operation.

Pumping fluid through the central bore 36 will also operate the hydraulic tensioning device 14. A back pressure will occur as fluid is pumped through the nozzle 38. This will result in fluid entering the ports 44 to fill the chamber 46. As the piston 66 is fixed in position on the inner mandrel 34 which in turn is fixed to the work string, the chamber 46 will expand by fluid pressure against the wall 58 of the locking sub 54. The locking sub 54 will therefore be forced upwards relative to the inner mandrel 34, taking the outer mandrel 32 with it. As the section mill 12 is connected to the outer mandrel 32 via the bottom sub 70, it will be raised relative to the work string 20 at a rate equal to the rate fluid enters the chamber 46. If the pump rate of fluid at surface through the central bore 36 is held constant then a constant load is applied to the section mill 12. Movement of the inner mandrel 34 will move the prong 76 into the nozzle 38 and the back pressure will now be controlled by the cross-sectional flow area at the nozzle 38. A pump flow rate from surface will have been calculated based on the cross-sectional flow area at mid-stroke, that is the position shown in FIGS. 2A-C for a desired rate of milling or rate of progress. This provides for even milling of the tubular 24 in the upward direction. It will be realised that a truly constant load cannot be achieved due to friction in the system and we may therefore consider the load to be substantially or near constant.

The work string 20 will be raised during filling of the chamber 46. This will have the effect of moving the piston 66 upwards and keep the chamber 46 from entirely filling. If the rate of raising the work string 20 is balanced against the pump rate of fluid filling the chamber 46 then a constant load or tension is applied to the section mill 12 and any length of section 22 can be milled continuously. However, it will be apparent that keeping this balance will be difficult.

If the outer mandrel 32 is raised faster than the work string 20, then the locking sub 54 risks hitting the box section 42 of the top sub 40. This will mean that the hydraulic tensioning device 14 has fully stroked and 'bottoming out' has occurred. At this point the load on the section mill 12 is unpredictable as it is entirely dependent on the load on the work string 20. When operated from a floating vessel 25 this would be undesirable as chattering could occur between the blades 80 and the tubular 24 causing potential damage to the section mill 12. In the present invention, the self-correcting mechanism 30 prevents this from occurring. Thus if the work string 20 is lifted faster than the milling rate, the device 14 will extend, the pressure will increase consequently increasing the weight on the mill. The increased weight or load on the mill will increase the rate of progress or milling rate and return the prong 76 and the inner mandrel 34 to the mid-stroke position. This is an automatic procedure which does not require any intervention from surface. The pressure can be monitored at surface to see the self-correction taking place.

It is noted that milling of the tubular 24 is continued throughout this operation as the work string 20 is raised or lifted at a desired rate of progress. In this way, the blades 80 are never stopped and thus overwear of the blades is prevented.

Conversely, if the work string 20 is raised at a slower rate than the milling rate, the chamber 46 will reduce in volume as the piston 66 is brought up to meet the wall 58 of the locking sub 54. This causes the device 14 to stroke inwards towards a contracted or closed position. The prong 76 is automatically repositioned in the nozzle 38, and the decrease in pressure means that the weight on the mill reduces. So, the rate of progress drops causing the device 14 to move back to the mid-stroke position. Again this occurs automatically with milling continuing and the work string 20 being raised at the desired rate of progress to achieve the desired milling rate.

Figure 4:
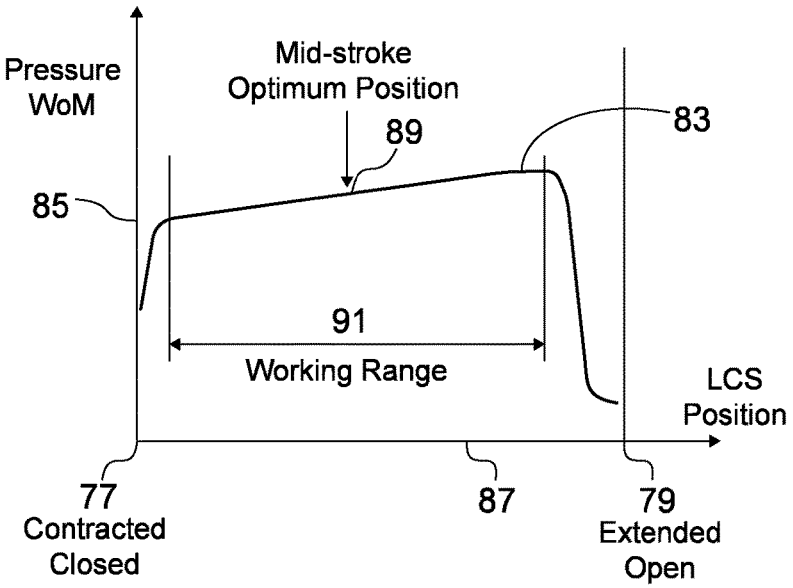
FIG. 4 is a graph of load on the section mill versus position of hydraulic tensioning device.

Referring to FIG. 4 there is illustrated a graph 83 of pressure/weight on mill 85 against position 87 of the device 14. This position can be considered as a full stroke length of the device 14 from a fully retracted or closed position 77 to a fully extended or open position 79. It is seen that at each end of the graph 83, the pressure can change dramatically. Thus it is preferable to work in the operating range 91 preventing the device from bottoming out at the end of the stroke. In this invention, the device 14 is operated between these two configurations and FIG. 4 shows a mid-stroke position 89 which is optimum. The graph 83 shows a gradient as a result of the variation in cross-sectional flow area through the nozzle induced by the tapering grooves 82 on the prong 76. This offers the means to auto-correct the device 14 and return it to the optimum mid-stroke position.

By monitoring pressure at surface the rate of lift of the work string can be adjusted if it is desired to change the rate of progress. This will be required when the section mill 12 reaches a coupling the tubing 24. At this point it may be desirable to stop lifting the string 20 and allow the the fluid to fill the chamber 46, thereby pulling the section mill towards the work string 20 and stroking the device 14 sufficiently to mill through the coupling. Once through the coupling the device 14 can be reset to the optimum mid-stroke position again and the work string 20 lifted at the desired rate of progress of the next tubular section.

The pressure (from the cross-sectional flow area at nozzle 38 in the mid-stroke position) and the size of the piston 66 are chosen along with an appropriate flow rate to give the correct force on the mill to get efficient rate of cutting but without damaging the cutting structure or else creating too much cuttings which could block the hole and cause the mill to get stuck in the ground.

Thus the process can be performed as:

1. Position apparatus below bottom of tubing.
2. Start pumps at surface:
   a. Device 14 will stroke upwards and blades 80 will go out in mill 12;
   b. Monitor pressure;

c. Note space out should have blades 80 below level of bottom of tubing even after they have stroked upwards.

3. Start rotation (note this could be achieved by a downhole motor so would start rotating when you start pumping).
4. Pick up slowly at surface until you see a pressure increase due to the prong 76 as the blades touch the underside of the tubing which strokes the tool.
5. Pick up a set amount to give some travel for cutting to reach a position between the fully extended position and the fully retracted position i.e. a mid-stroke position.
6. Keep going at your desired rate of progress while monitoring pressure to see that the device is auto-correcting until you have milled the length of section which you need.

By auto-correcting and maintaining the device at the mid-stroke, this provides continuous milling over any section 22 of tubing to be cut in a single trip in the well without retracting the blades 80 at any time. By continuous milling we mean milling sections of tubing of lengths greater than the stroke length of the device 14 without stopping the blades or the milling action at any time.

Those skilled in the art will recognise that the auto-correction can maintain the lower end of the device at any position between the fully extended position and the fully retracted position. It does not require to be at precisely the middle of the stroke length. Thus mid-stoke should be interpreted as any position between the fully extended position and the fully retracted position, so that the load can be corrected and controlled.

Those skilled in the art will recognise that the device 14 could be configured such that the inner and outer mandrel connections are reversed i.e. the inner mandrel being connected to the section mill while the outer mandrel is connected to the work string. Additionally, the grooves could be located on an inner surface of the inner mandrel and the prong could provide a short cylindrical portion to provide the variation on cross sectional flow area when travelling through the grooved profile. Further shear pins can be arranged between the mandrels so that relative movement can only occur once a predetermined back pressure is reached. In this way, the mandrels can be set at the mid-stroke position for run-in and will shear at a pressure just below the pumped flow rate.

The apparatus 10 and method find particular use in a rigless method for well abandonment as described in WO 2016/156862 to the present applications. The steps in this well abandonment procedure are illustrated in FIGS. 5A-G.

Figures 5A, 5B, 5C, 5D, 5E, 5F, 5G:
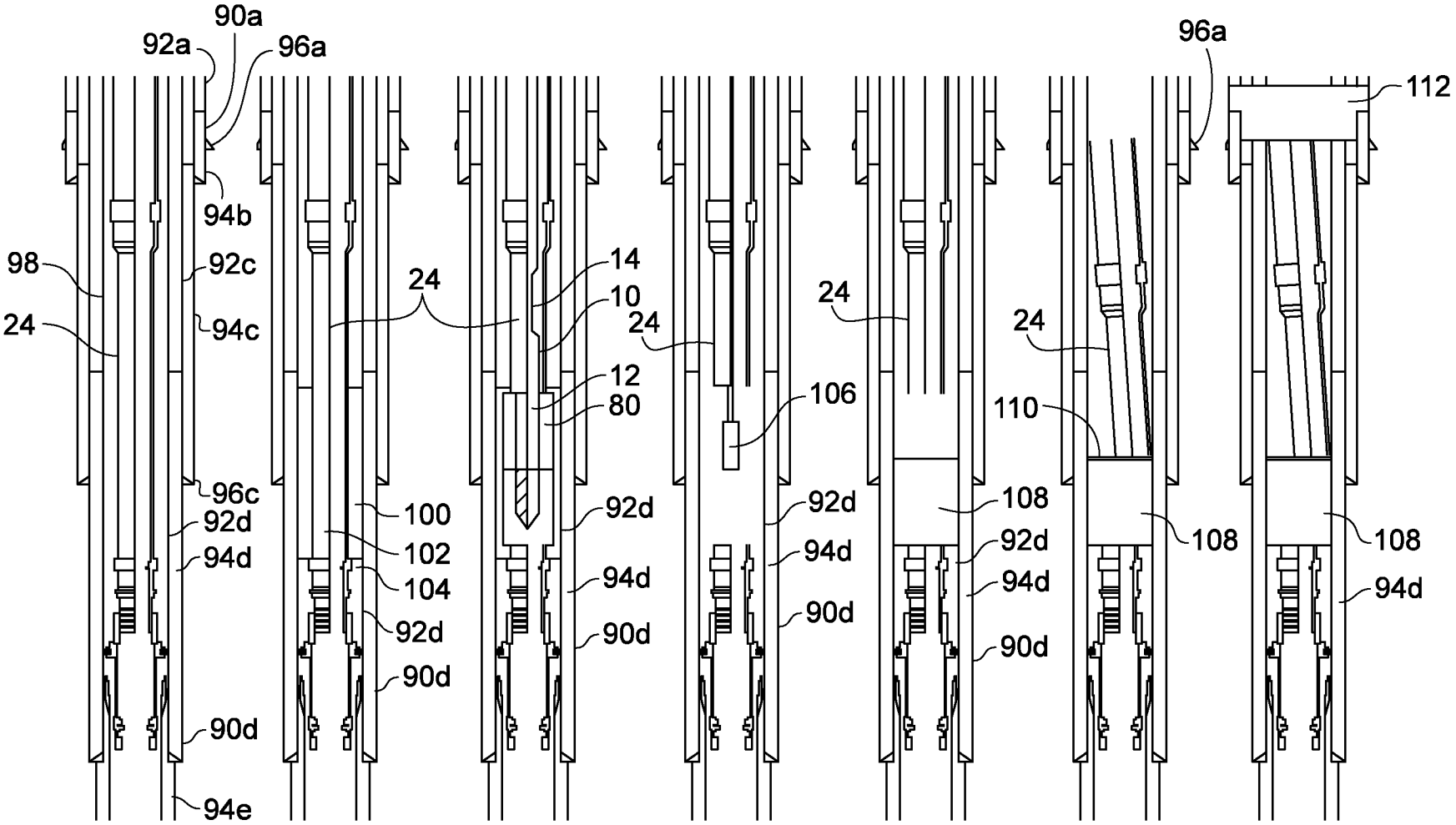
FIGS. 5A to 5G are views of a well bore illustrating steps in a method of abandoning a well using an apparatus and method according to an embodiment of the present invention.

FIG. 5A shows a typical well with five strings of casing and tubing installed. The initial section of wellbore 90*a* was drilled to a certain depth, after which casing 92*a* was run into the well. Cement 94*a* was set over a portion of the outside of the casing 92*a*, sealing the annulus between the casing 92*a* and the wellbore 90*a*. The next section of wellbore 90*b* was then drilled to the target depth of the well. A next section of casing 92*b* was run into the well, suspended inside the first casing 92*a* with a hanger 96*a* and likewise cemented 94*b* to seal the annulus between the second casing 92*b* and the wellbore 90*b*. This is repeated until the well reaches the desired depth. A liner 98 can then be tied back to surface. An inner tubular 24 which is the production tubing is then run in to complete the well as is known in the art. When the time comes to abandon the well, the typical approach is to remove the production tubing 24 using a rig. A cement bond log (CBL) can then be made over a length of the well in which there is a cement sheath 94*d* between the respective casing 92*d* and the wellbore 90*d*. If the bond is good then a cement plug can be placed inside the casing 92*d*. However, if the bond does not have the required integrity the casing 92*d* is milled out usually downwards from the hanger 96*c*. The cement sheath 94*d* is reamed away and then a cement plug formed across the entire wellbore 90*d*. As detailed this approach requires a rig from which the production tubing can be pulled.

An alternative approach which can be used in a rigless arrangement i.e. from a floating vessel which does not require the expense of a rig, is described in WO 2016/156862. In FIG. 5B, it is seen that the production tubing 24 is left in place. The tubing 24 is perforated and a gel or other settable material 100 squeezed through the perforations 102 to fill an annulus 104 between the tubing 24 and the casing 92*d*. The material 100 advantageously holds the production tubing 24 in place so that it can be milled.

FIG. 5C shows the apparatus 10 of the present invention being used to upwardly mill the production tubing 24 while leaving the casing 92*d* Intact. Any length of the tubing can be removed and ideally a length sufficient to form a cement plug to legislative requirements would be selected. With the production tubing 24 milled away, the casing 92*d* is now exposed and a cement bond log can now be performed over the section 22 using a CBL tool 106 as is known in the art. This is shown in FIG. 5D. If the CBL is satisfactory, a cement plug 108 is formed in the wellbore 90*d* as illustrated in FIG. 5F.

If desired the procedure can include the steps of spotting sand 110 on top of the cement plug 108 acting as the primary barrier. The production tubing 24 can be cut together with the control lines so as to free the completion below the uppermost hanger 96*a*. This is illustrated in FIG. 5F. The hanger seals can then be pulled and recovered before a secondary barrier in the form of a further cement plug 112 is put in place as shown in FIG. 5G to finish abandonment of the well.

The principal advantage of the present invention is that it provides a method for removing a section of well tubing in a rigless arrangement were milling is continuous.

A further advantage of an embodiment of the present invention is that it provides a method for removing a section of well tubing on a single trip in a well.

A still further advantage of an embodiment of the present invention is that it provides apparatus that self-corrects to maintain a hydraulic tensioning device in an optimum mid-stroke position to provide continuous milling at a rate of progress matching the rate at which the work string is lifted.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended. For example, while the section mill is described for upward movement to mill the tubular, the section mill could be adapted to operate in a downward fashion also.

I claim:

1. Apparatus for removing a section of well tubing comprising:

a work string;

a hydraulic tensioning device having an upper end and a lower end, the upper end being attachable to the work string, the lower end being moveable longitudinally relative to the upper end by a stroke length between a fully extended position and a fully retracted position in response to fluid pressure within the hydraulic tensioning device and a load applied on either end;

a section mill attachable to the lower end of the hydraulic tensioning device, the section mill including a plurality of blades, the blades being arranged to move from a first position within the section mill to a second position being extended to contact the well tubing and thereby mill the tubing in an upward direction;

characterised in that:

the hydraulic tensioning device includes a self-correcting mechanism to maintain the lower end between the fully extended position and the fully retracted position to provide continuous milling of the well tubing by the section mill at a rate of progress matching a rate at which the work string is lifted.

2. Apparatus according to claim 1 wherein the work string has a through bore for fluid to pass from surface to extend the blades and move the lower end of the hydraulic tensioning device relative to the upper end.

3. Apparatus according to claim 1 wherein the hydraulic tensioning device comprises a cylindrical body providing an outer mandrel and an inner mandrel telescopically arranged in respect to the outer mandrel, with a cylindrical bore therethrough.

4. Apparatus according to claim 3 wherein the outer mandrel includes a prong having an elongate body arranged on a central axis of the cylindrical body and the inner mandrel includes a restriction therein, which limits the passage of fluid through the cylindrical bore when the prong is arranged in the restriction.

5. Apparatus according to claim 4 wherein the self-correcting mechanism comprises a profile on an outer surface of the elongate body of the prong.

6. Apparatus according to claim 5 wherein the profile comprises one or more longitudinally arranged grooves on the outer surface and wherein a depth of each groove varies along a length of the groove.

7. Apparatus according to claim 6 wherein the depth of each groove is tapered.

8. Apparatus according to claim 1 wherein the apparatus includes a downhole motor.

9. Apparatus according to claim 1 wherein the work string is coiled tubing.

10. Apparatus according to claim 1 wherein the apparatus includes an anchor to prevent rotation of the work string.

11. Apparatus according to claim 1 wherein a spiral auger is located below the section mill to assist in moving cuttings downhole.

12. A method for removing a section of well tubing comprising the steps:

a) providing a work string with a hydraulic tensioning device and a section mill mounted below the hydraulic tensioning device, the hydraulic tensioning device operating over a stroke length between a fully extended position and a fully retracted position;

b) selecting a desired rate of progress and calculating a pump flow rate to create a back pressure in the hydraulic tensioning device to maintain the hydraulic tensioning device between the fully extended position and the fully retracted position;

c) lowering the work string into tubing to be milled;

d) pumping fluid through the work string to actuate the section mill and extend cutter blades;

e) rotating the section mill to mill the tubing with the cutter blades;

f) pumping fluid at the calculated pump flow rate through the work string and actuating the hydraulic tensioning device to position the lower end of the hydraulic tensioning device between the fully extended position and the fully retracted position while milling the tubing;

g) maintaining the calculated pump flow rate while raising the work string at the desired rate of progress to continuously mill the tubing;

h) in the event that the rate of milling is lower than the desired rate of progress and the lower end of the hydraulic tensioning device moves downwards away from the work string towards the fully extended position, auto-correcting the hydraulic tensioning device to return to a position between the fully extended position and the fully retracted position by increasing a load on the section mill to thereby speed up the rate of milling;

i) in the event that the rate of milling is higher than the desired rate of progress and the lower end of the hydraulic tensioning device moves upwards towards the work string towards the fully retracted position, auto-correcting the hydraulic tensioning device to return to a position between the fully extended position and the fully retracted position by decreasing a load on the section mill to thereby slow down the rate of milling;

j) repeating steps (h) and (i) as required while performing step (g) to remove a longitudinal section of the tubing.

13. A method for removing a section of well tubing according to claim 12 wherein the hydraulic tensioning device has an upper end and a lower end, the upper end being attachable to the work string, the lower end being moveable longitudinally relative to the upper end by a stroke length between a fully extended position and a fully retracted position in response to fluid pressure within the hydraulic tensioning device and a load applied on either end; and includes a self-correcting mechanism to maintain the lower end between the fully extended position and the fully retracted position to provide continuous milling of the well tubing by the section mill at a rate of progress matching a rate at which the work string is lifted.

14. A method for removing a section of well tubing according to claim 12 wherein the auto-correction occurs by changing a flow area through the hydraulic tensioning device in response to movement of the lower end of the hydraulic tensioning device.

15. A method for removing a section of well tubing according to claim 12 wherein step (f) includes using the fluid flow through the hydraulic tensioning device to actuate the hydraulic tensioning device to hydraulically pull a lower end of the hydraulic tensioning device upwards towards the work string to a position between the fully extended position and the fully retracted position while milling the tubing.

16. A method for removing a section of well tubing according to claim 12 wherein step (f) includes raising the work string at a rate faster than the desired milling rate so as to actuate the hydraulic tensioning device to extend such that the lower end of the hydraulic tensioning device moves downwards relative to the work string to a position between the fully extended position and the fully retracted position while milling the tubing.

17. A method for removing a section of well tubing according to claim 12 wherein step (f) includes shearing one or more pins to allow the lower end of the hydraulic tensioning device to move relative to the work string.

18. A method for removing a section of well tubing according to claim 12 wherein the method include the step of changing the desired rate of progress by varying the pump flow rate through the work string in combination with raising the work string at the changed desired rate of progress.

19. A method for removing a section of well tubing according to claim 12 wherein the method includes the additional steps of stopping raising the work string so as to allow the lower end of the hydraulic tensioning device to move upwards towards the work string while milling the tubing.

20. A method for removing a section of well tubing according to claim 12 wherein the work string is lowered from a floating vessel.

* * * * *